US005803374A

United States Patent [19]

Beckschulte

[11] Patent Number: 5,803,374

[45] Date of Patent: Sep. 8, 1998

[54] BREAKDOWN TOOL

[75] Inventor: Heinrich Beckschulte, Salzkotten, Germany

[73] Assignee: Gebrueder Loedige Maschinenbaugesellschaft mbH, Paderborn, Germany

[21] Appl. No.: 864,936

[22] Filed: May 29, 1997

[30] Foreign Application Priority Data

Jun. 11, 1996 [DE] Germany ..... 196 23 217.1

[51] Int. Cl.[6] ..... B02C 18/06; B02C 18/18

[52] U.S. Cl. ..... 241/27; 241/28; 241/291; 241/292.1

[58] Field of Search ..... 241/46.11, 46.17, 241/291, 292.1, 24.29, 27, 28

[56] References Cited

U.S. PATENT DOCUMENTS 4,973,002 11/1990 Waller et al. ..... 241/46.17 X

FOREIGN PATENT DOCUMENTS 0370181 5/1990 European Pat. Off. .
2396941 2/1979 France .
1184325 12/1964 Germany .
3406648 9/1985 Germany .
3831609 3/1990 Germany .

OTHER PUBLICATIONS

"Industrial Mixing in Continuous Lödige Mixer" company brochure by Gebr. Lödige GmbH published May 1993.

*Primary Examiner*—John M. Husar
*Attorney, Agent, or Firm*—Paul Vincent

[57] ABSTRACT

A breakdown tool (10) for solid materials having fibrous constituents is attached to a container. The container accepts the material in a batch or continuous fashion. The breakdown tool (10) includes one or more material breakdown elements (21) which are disposed at separations from each other on or at a shaft (20). The outer girth of the shaft (20) in the region between the material breakdown elements (21) is larger than the maximum fiber length of the fibrous constituents occurring during the breakdown process. For this reason, the fibrous constituents occurring during the breakdown processing cannot interfere with the functioning of the breakdown tool (10). The breakdown process can consequently be carried out without interruption.

13 Claims, 2 Drawing Sheets

BREAKDOWN TOOL

This application claims Paris Convention priority of German patent application No. 196 23 217.1 filed Jun. 11, 1996 the disclosure of which is hereby incorporated by reference.

BACKGROUND OF THE INVENTION

The invention concerns a breakdown tool for solid materials having fibrous constituents in a container which accepts the material in a batch or continuous fashion, wherein the breakdown tool comprises one or more material breakdown elements, which are disposed at separations from another on or at a rotatable shaft.

A breakdown tool of this kind is known in the art, e.g. through the company brochure "Industrial Mixing in a Continuous Löbdige Mixer" dated 5/1993 and published by Gebrüder Lödige GmbH.

The conventional breakdown tools are utilized for supplementing a mixer (shaft and mixing elements) in a plurality of mixing processes. Among other applications, breakdown tools are utilized for breaking-up clumps which are product-, process- and/or time-dependent. They break down pasty additives or prevent the formation of agglomerates during moisturizing processes. The necessity for utilizing a breakdown tool results from the advantageous control of agglomeration and compression processes.

The conventional breakdown tools in accordance with the above mentioned brochure are introduced in a continuous processing machine essentially comprising a horizontally positioned cylindrical container (drum). The motional dependence of the bulk material in the mixing volume changes in dependence on the Froude number of the mixing element motion. In the event of a slowly rotating mixer, the product is raised in the direction of rotation so that the free product surface assumes an angle corresponding approximately to the bulk material angle of the product. When the mixer revolution rate increases an increased number of particles are accelerated out of the material bed into the free mixing volume. In the range of high mixer revolutions, a more or less closed product ring is present in the mixing volume. The product ring has a consistency corresponding to that of a compressed bulk.

Recyclable materials are utilized to an ever increasing extent for the production of insulation boards. Jute fibres from jute sacks as well as used paper are substantially utilized therefor. These materials are initially broken down with chemical additives and subsequently homogenized to as thorough a degree as possible. Jute fibres result from the processing of discarded jute sacks. The discarded jute sacks contain binding and sealing twine which, following a coarse breakdown of the jute sacks, can have lengths up to 600 mm. In contrast thereto, the fibres woven in the sack cloth can be effectively cut and are normally approximately 40 mm in length. The binding twine utilized in the jute sacks has a disadvantageous large degree of toughness and therefore is very difficult to chop or cut.

During the course of breaking down and homogenizing the above mentioned materials using the conventional breakdown tool, the fibres initially wrap around the shaft and subsequently also around the material breakdown elements.

Even after a short period of time, the breakdown tool is completely enwrapped and encased in a mushroom-shaped ball. In this state, the conventional breakdown tool can no longer be used for the breakdown of materials. This results in interruption of the processing, a disassembly of removable components, and a subsequent cleaning. However, subsequent additional incomplete breakdown of the jute sack fibres once more leads to deposits on the breakdown tools shortly after resuming operation. For this reason the conventional breakdown tools are not suitable for breaking down solid materials having single fibre constituents.

It is therefore the purpose of the present invention to improve the breakdown tool of the above mentioned kind to such an extent that fibre-like constituents occurring during the homogenization processing of solid materials do not compromise the operation of the breakdown tool such that the breakdown procedure can be carried out without interruption.

SUMMARY OF THE INVENTION

This purpose is achieved in accordance with the invention in that the outer girth of the shaft in the region between the material breakdown elements is larger than the maximum fibre length of the fibrous constituents occurring during the breakdown procedure.

The rotatable shaft to which the breakdown tool in accordance with the invention can be attached, is generally disposed on a container wall and advantageously configured in such a fashion that its bearing directly hinders an axial displacement. A plurality of material breakdown elements (knife blades or the like) are provided for on the shaft in the radial direction. The material breakdown elements are slid onto the shaft and fixed with conventional attachment mechanisms. The shaft region between the material breakdown elements has a diameter which is appropriately large to exceed the fibre length occurring during the breakdown procedure. The fibres which occur can be reduced in size down to 250 mm to 300 mm so that an outer diameter of the shaft between 80 mm to 130 mm can be sufficient. For this reason plastic, jute or used paper fibres can no longer completely surround this region of the shaft: no formation of composite fibre agglomerates encasing the cutting head in a mushroom-shaped fashion occurs.

The breakdown tools in accordance with the invention can have blades, knives and the like of the most differing kinds for use as material breakdown elements. In this manner, the breakdown tools in accordance with the invention can be advantageously utilized for a long period of time without interruption to breakdown tough and solid twine fibrous constituents. Through appropriate combination of the material breakdown elements (cutting head shapes) and proper selection of the material used for the breakdown tools and for the shaft, the breakdown process can be improved and controlled to a greater degree through the action of the cutting head. In addition, the breakdown tools or the material breakdown elements can be manufactured from special materials or coated with same.

Heat insulation boards having a homogeneous structure can be produced in a controlled fashion using a container equipped with the breakdown tools in accordance with the invention. The breakdown tool in accordance with the invention is thereby utilized to break down and mix jute fibres, plastic fibres, and paper fibres originating from used paper as well as powder-like chemical bonding substances (e.g. resins and flame-retardents). The materials mentioned are homogeneously mixed by the breakdown tool supported by conventional mixing tools (ploughshare blades).

In a preferred embodiment, spacer bushings are provided for between the material breakdown elements to increase the outer diameter of the shaft in this region. Use of the spacer bushings allows for the shaft itself, to which the material breakdown elements are attached, to remain unchanged in diameter. Differing spacer bushings can be utilized in dependence on the fibre length expected in the mixture for defined prevention of encasement of the breakdown tools. A differing number of spacer bushings having equal outer girth are required in dependence on the number of material breakdown elements utilized. The utilization of spacer bushings also facilitates the retroactive fitting of conventional breakdown tools to equip same for use in processing tough fibrous constituents. Spacer bushings having an outer diameter from 80 mm to 130 mm are adequate for most breakdown processes.

It is particularly preferred when the shaft or the spacer bushings have a smooth outer surface with low tendency to adhesion in the region between the material breakdown elements. An appropriate processing or coating of the surface with anti-adhesive materials prevents sticking of the fibres to the shaft or to the breakdown tool. The operation time of the breakdown tool is consequently increased to an even further extent, since the influence of the fibres on the processing effects of the breakdown tool are further reduced.

In an improvement of the embodiment having spacer bushings, the spacer bushings are made from plastic. This type of spacer bushing advantageously has low weight. For this reason the rotational motion of the breakdown tool is not influenced. The low weight of the spacer bushings e.g facilitates continued use of the bearings which are already present in the container.

In an additional variation, the spacer bushings are made from a light metal. These spacer bushings likewise have the advantage of being light-weight, so that processing is not effected by the breakdown tools. Similarly, the energy used during operation of the breakdown tools in accordance with the invention does not increase compared to that of the conventional breakdown tools.

In an additional embodiment, the material breakdown elements are attached to the shaft using a screwable cup-like sealing element having a rounded spherical-shell shaped outer surface. The sealing element thereby has a maximum outer girth corresponding to the outer girth of the shaft. This special configuration of the sealing element guarantees that fibres do not accumulate on the portion of the breakdown tool facing the center of the container. The spherical shell-like geometry of the sealing element causes slide-off of the fibres incident on the sealing element and enhanced guiding towards the material breakdown elements (knives). In this fashion the breakdown procedure is improved and a lock-up of the breakdown tool prevented.

The use of rounded fibre knives as material breakdown elements allows for precise processing of the fibres without splicing at their points of intersection.

Due to the product pool which establishes itself inside of the container, it is advantageous to provide for a plurality of breakdown tools which are positioned, as seen in the radial direction, in the container within a polar region between 6 o'clock and 9 o'clock (between 120° to 270°). This leads to improved homogenization of the product to be mixed.

For the same reason other embodiments are possible with which a plurality of breakdown tools are disposed along the container in the axial direction.

In a further embodiment, a coarse treatment of the material to be processed is facilitated by a cutting element which is adjacent to the material breakdown element directed towards a container wall and which has an appropriate outer girth larger than the maximum fibre length occurring during processing.

In an improvement of this variation, channels are fashioned in the cutting element which travel radially toward the shaft. The channels can also be connected to each other by means of a central annular groove. The flowing-in and out of air in the channels allows for blow-off of fibres accumulated in the region of the cutting element. This cleaning effect guarantees the functionality of the cutting element during operation of the breakdown tool in accordance with the invention. The air needed to clean the cutting element is sucked-in from outside of the machine and guided through the bearing into the inner region of the machine.

The additional air thereby streaming into the product region assures that fibres or other product components cannot accumulate on the cutting element.

Clearly, in addition to the material breakdown elements, other types of processing elements can also be disposed on the shaft for utilization in the processing procedures discussed herein. The shafts are driven by electrical motors. A transmission can also be provided for between the shafts and the motors.

Additional advantages can be derived from the description of the accompanying drawing. The above mentioned features and those to be further described below can be utilized in accordance with the invention individually or collectively in arbitrary combination. The embodiments mentioned are not to be considered as exhaustive enumeration rather have exemplary character.

The invention is represented in the drawing and will be further explained in connection with an embodiment:

BRIEF DESCRIPTION OF THE DRAWING

FIG. 2 shows an end view of the container according to

FIG. 1 without bearing and transmission for the processing shaft;

DESCRIPTION OF THE PREFERRED EMBODIMENT

The representations shown in the figures illustrate the object in accordance with the invention in a highly schematic fashion and are not necessarily to be taken to scale.

Figure 1:
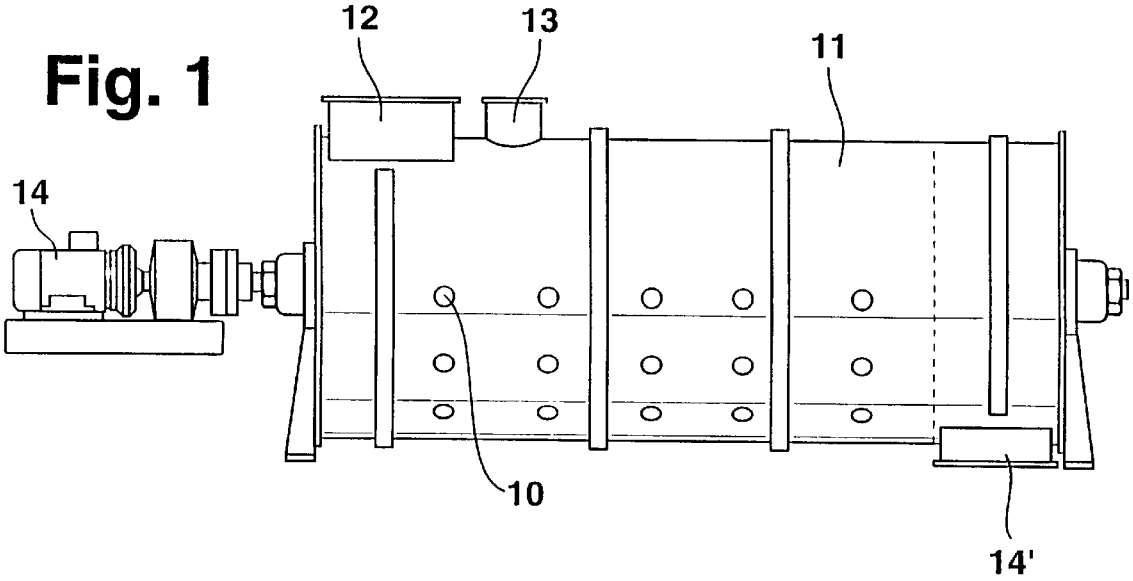
FIG. 1 shows a side view of a container having a plurality of breakdown tools in accordance with the invention introduced therein.

FIG. 1 demonstrates the application of breakdown tools 10. In the figure only one of a plurality of breakdown tools 10 disposed in a container 11 is assigned a reference symbol. The container 11 can be filled with solid materials having fibrous constituents via a receiving means 12 and 13. A processing shaft, which is not shown in the figure, travels completely through and rotates within the container 11 and can have mixing elements such as ploughshare blades disposed thereon for mixing the materials. The processing shaft is driven by an electrical motor 14 and is borne on each end of the container 11. The material to be processed within the container 11 can exit through a material outlet port 14' to leave the container 11. The break down tools 10 are provided for even homogeneous mixing of the solid materials. A breakdown tool 10 will be described in detail later in connection with FIG. 3. The breakdown tools 10 are attached in a distributed fashion along the radial as well as axial directions on the container 11 for effecting homogeneous mixing.

Figure 2:
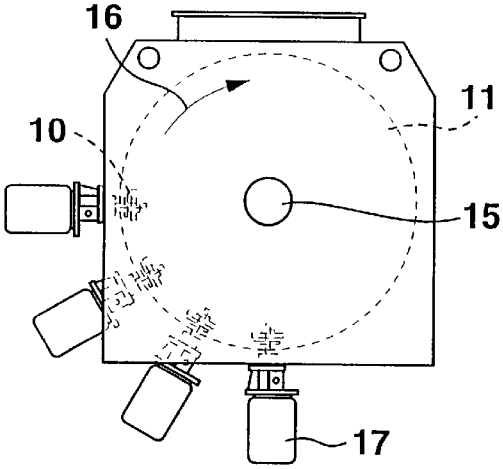

FIG. 2 shows an end view of the container 11 (without bearing and without transmission for the processing shaft 15). The processing shaft 15 is located within the drum-shaped container 11. Processing elements (not shown) are disposed on the processing shaft 15 for the homogeneous mixing of the material located in the container 11. Towards this end the processing shaft 15 rotates in the direction of arrow 16. A plurality of breakdown tools 10 are disposed at a container wall in the container 11 within, as seen in the radial direction, a circular segment between 180° and 270° (6 o'clock to 9 o'clock). The breakdown tools 10 are each driven by an electrical motor 17. The breakdown tools 10 are disposed in the radial direction in such a fashion that they can engage the material to be broken down for the product pool established within the container 11.

Figure 3:
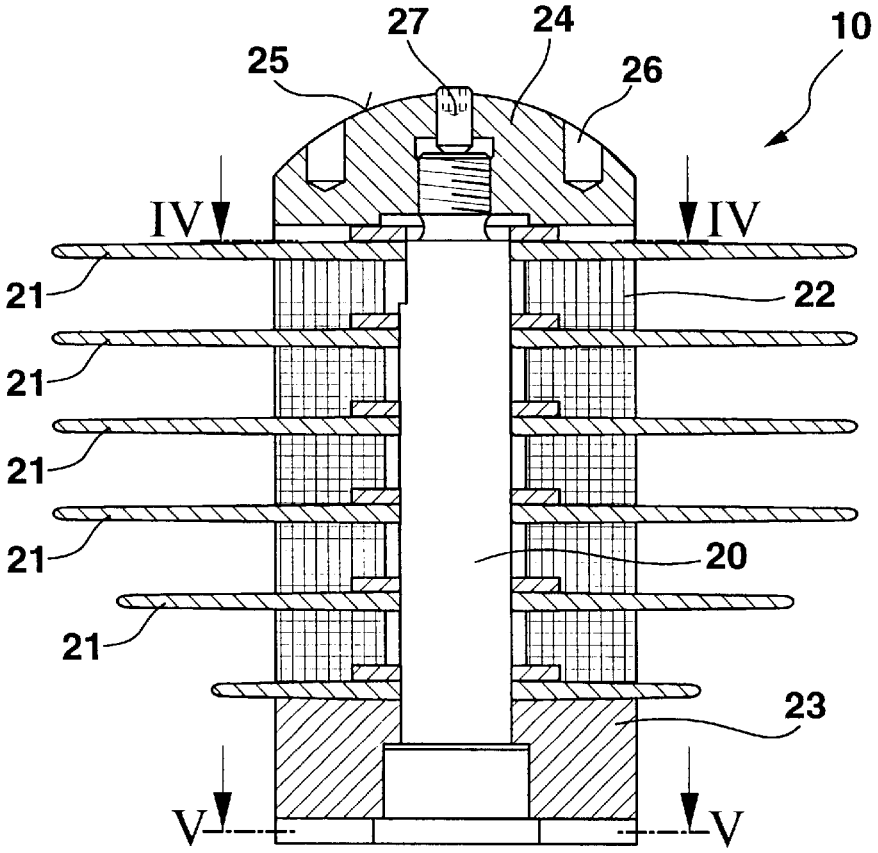
FIG. 3 shows a cross section through a breakdown tool in accordance with the invention.

FIG. 3 shows a longitudinal cut through a breakdown tool 10. The breakdown tool 10 substantially consists of a rotatably borne shaft 20 upon which a plurality of material breakdown elements 21 are attached. The material breakdown elements 21 serve for the processing (breaking down, mixing, chopping and reduction in size) of solid materials such as bulk materials having fibrous constituents. The material breakdown elements 21 are rounded fibre knives. Spacer bushings 22 are located between the mutually separated material breakdown elements 21 to expand the outer diameter of the shaft 20. The spacer bushings 22 are lightweight and are preferentially made from plastic. A cutting element 23 is adjacent to the lowermost breakdown element 21 for the processing of solid materials. The outer girth of the spacer bushings 22 and the cutting elements 23 can be adjusted, through choice of the outer diameter of the spacer bushings 22 and cutting elements 23, to be larger than the length of the fibres which are produced in the container during processing or which are introduced into the container. For this reason it is not possible for fibres to accumulate on the breakdown tool 10 between the material breakdown elements 21 to encroach upon the effectivity of the breakdown tool 10. The material breakdown elements 21 are slid onto the shaft 20 and attached using a sealing element 24. The sealing element 24 has a rounded spherical shell-shaped outer surface 25. The maximum outer girth of the sealing element 25 is likewise larger than a maximum expected fibre length occurring inside the container. In this fashion, it is also not possible for fibres to accumulate on the sealing element 24 to encroach upon the functioning of the uppermost material breakdown element 21. The sealing element 24 has recesses 26 which facilitate an easy screwing-on of the sealing element 24. In addition, same can be attached to the shaft 20 by means of an attachment screw 27. In order to prevent a lock-up of the breakdown tool 10, all surfaces of the breakdown tool 10, such as the sealing element 24, the spacer bushings 22, and the cutting element 23 can have surfaces exhibiting a reduced tendency to adhesion. The reduced tendency to adhesion can, e.g. be effected through a special processing of the surfaces or by means of a coating of the surfaces using an appropriate material.

Figure 4:
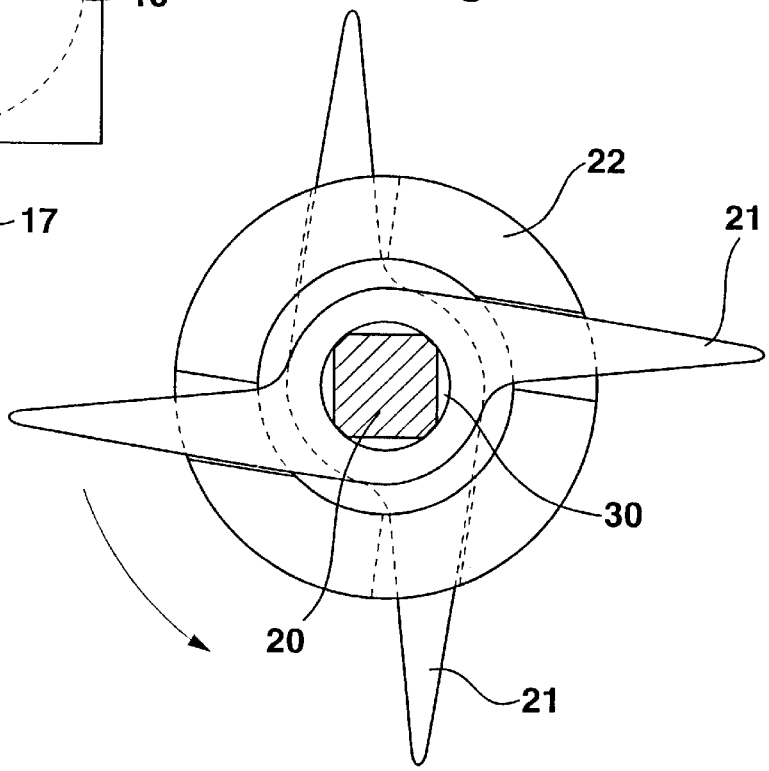
FIG. 4 shows a cut along the line IV—IV through the breakdown tool according to FIG. 3.

FIG. 4 shows a cut along the line IV—IV through the breakdown tool 10 in accordance with FIG. 3. The material breakdown element 21 is configured in a propeller-like fashion and has a central opening 30 for attachment of the material breakdown element 21 to the shaft 20. The shaft 20 has a four-sided cross section so that rotation of the shaft 20 also effects mutual rotation of the material breakdown element 21. A spacer bushing 22 is located below the material breakdown element 21 which separates one material breakdown element 21 from another breakdown element 21. The spacer bushing 22 increases the outer diameter of the shaft 20. As a result, it is only possible for fibres to accumulate on the breakdown tool 10 which have a length larger than the girth of the spacer bushing 22. Appropriate choice of the outer diameter of the spacer bushing 22 prevents deposition and lock-up of the breakdown tool 10.

Figure 5:
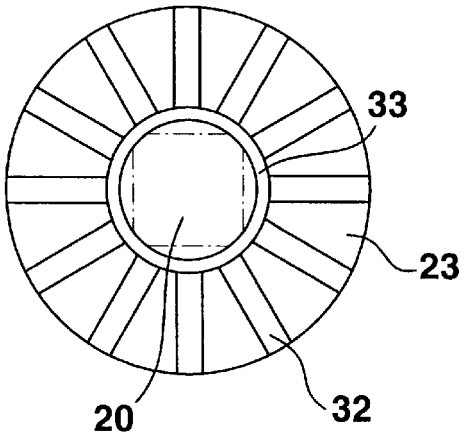
FIG. 5 shows a cut along the line V—V through the breakdown tool in accordance with FIG. 3.

FIG. 5 shows a cut along the line V—V through a breakdown tool 10. The cutting element 23 is attached to the processing shaft 20. The cutting element 23 has channels 32 which are mutually connected by means of a central annular groove 33 and which are connected to the ambient surroundings external to the container. Air can stream into and out of the cutting element 23 via the channel 32 during rotation of the cutting element 23 to thereby effect removal of threads deposited on the cutting elements 23. The channels 33 facilitate self-cleaning of the cutting element 23. The air necessary therefor is sucked-in from outside of the container via the rotational motion of the breakdown tool and introduced into the container. The air flows through the channels to keep the breakdown tool free from product accumulation in the vicinity of the cutting element 23.

A breakdown tool 10 for use with solid materials such as bulk materials having fibrous constituents is attached to a container. The container accepts the material in a batch or continuous fashion. The breakdown tool 10 includes one or more material breakdown elements 21 which are disposed at separations from each other on or at a shaft 20. The outer girth of the shaft in the region between the material breakdown elements 21 is larger than the maximum fibre length of the fibrous constituents occurring during the breakdown process. For this reason, the fibrous constituents occurring during the breakdown processing cannot interfere with the functioning of the breakdown tool 10. The breakdown process can consequently be carried out without interruption.

I claim:

1. A breakdown tool means for breakdown of solid materials having fibrous constituents in a container, the container for accepting the solid materials in batch or continuous fashion, the breakdown tool means having a breakdown tool, the breakdown tool comprising:

a rotatable shaft having an outer diameter;

a first breakdown element disposed on said shaft; and a second breakdown element disposed on said shaft at a separation from said first breakdown element, wherein said outer diameter, in a region between said first and said second breakdown elements, is greater than 80 mm and less than 130 nm.

2. The breakdown tool means of claim 1, further comprising a spacer bushing disposed in said region between said first and second breakdown elements to increase said outer girth in said region.

3. The breakdown tool means of claim 2, wherein said bushing has a smooth surface with a low tendency to adhesion in said region.

4. The breakdown tool means of claim 2, wherein said spacer bushing is made from plastic.

5. The breakdown tool means of claim 2, wherein said spacer bushing is made from a light metal.

6. The breakdown tool means of claim 1, wherein said shaft has a smooth surface with a low tendency to adhesion in said region.

7. The breakdown tool means of claim 1, further comprising a sealing element for attaching said first and second breakdown elements to said shaft, said sealing element having a rounded outer surface and an outer girth corresponding to said outer girth of said shaft.

8. The breakdown tool means of claim 1, wherein said first and said second breakdown elements comprise rounded fibre-cutting knives.

9. The breakdown tool means of claim 1, further comprising a plurality of additional breakdown tools disposed on the container in an azimuthal angular region between 180° and 270° degrees with respect to a vertical direction.

10. The breakdown tool means of claim 1, further comprising a plurality of additional breakdown tools disposed on the container along an axial direction thereof.

11. The breakdown tool means of claim 1, further comprising a cutting element having an outer girth larger than a maximum occurring fibre length, said cutting element disposed on said shaft adjacent to a breakdown element facing a container wall.

12. The breakdown tool means of claim 11, wherein said cutting element has channels travelling radially towards said shaft.

13. A method for breakdown of solid materials having fibrous constituents in a container using a breakdown tool means having a breakdown tool, the breakdown tool having a rotatable shaft with an outer girth, a first breakdown element disposed on the shaft, and a second breakdown element disposed on the shaft at a separation from the first breakdown element, the method comprising the steps of:

introducing the solid materials into the container in one of a batch and continuous fashion; and breaking-down the fibrous constituents to a maximum fiber length less than the outer girth of the rotatable shaft, wherein said shaft has an outer diameter greater than 80 mm and less than 130 mm.

* * * * *

UNITED STATES PATENT AND TRADEMARK OFFICE

CERTIFICATE OF CORRECTION

PATENT NO. : 5,803,374

DATED : September 8, 1998

INVENTOR(S) : Heinrich Beckschulte

It is certified that error appears in the above-identified patent and that said Letters Patent is hereby corrected as shown below:

In claim 1:

Please replace in the last line of claim 1 "130 nm" with --130 mm--

Signed and Sealed this

Twenty-ninth Day of December, 1998

*Attest:*

*Attesting Officer*

BRUCE LEHMAN

*Commissioner of Patents and Trademarks*